US006945432B2

(12) United States Patent
Laible

(10) Patent No.: US 6,945,432 B2
(45) Date of Patent: Sep. 20, 2005

(54) DOSING AND/OR DISPENSING SYSTEM

(76) Inventor: Rodney Laible, 16315 Pawnee Rd., Bennington, NE (US) 68007

( * ) Notice: Subject to any disclaimer, the term of this patent is extended or adjusted under 35 U.S.C. 154(b) by 12 days.

(21) Appl. No.: 10/736,962

(22) Filed: Dec. 17, 2003

(65) Prior Publication Data

US 2004/0134941 A1 Jul. 15, 2004

Related U.S. Application Data

(63) Continuation-in-part of application No. 10/685,549, filed on Oct. 15, 2003, which is a continuation-in-part of application No. 10/372,375, filed on Feb. 22, 2003, and a continuation-in-part of application No. 10/074,469, filed on Feb. 12, 2002, now abandoned.

(51) Int. Cl.[7] ..... B67D 5/06
(52) U.S. Cl. ..... 222/185.1; 222/518
(58) Field of Search ..... 222/181.1, 185.1, 222/189.09, 481.5, 518

(56) References Cited

U.S. PATENT DOCUMENTS

| | | | | | |
|---|---|---|---|---|---|
| 1,305,476 | A | * | 6/1919 | McCord | 222/449 |
| 3,123,107 | A | * | 3/1964 | Kappler | 141/352 |
| 4,401,272 | A | | 8/1983 | Merton et al. | 239/337 |
| 5,048,723 | A | | 9/1991 | Seymour | 222/81 |
| 5,154,212 | A | * | 10/1992 | Weber | 141/353 |
| 5,350,091 | A | | 9/1994 | Leete et al. | 222/529 |
| 5,368,025 | A | | 11/1994 | Young et al. | 222/189.06 |
| 5,472,124 | A | | 12/1995 | Martushev | 222/529 |
| 5,526,961 | A | * | 6/1996 | Burrows | 222/185.1 |
| 5,706,985 | A | * | 1/1998 | Feer | 222/185.1 |
| 5,988,456 | A | | 11/1999 | Laible | 222/464.1 |
| 6,062,435 | A | | 5/2000 | Hess, III | 222/175 |
| 6,131,774 | A | * | 10/2000 | Thomas et al. | 222/181.2 |
| 6,299,037 | B1 | | 10/2001 | Lee | 222/518 |

* cited by examiner

*Primary Examiner*—Joseph A. Kaufman
(74) *Attorney, Agent, or Firm*—Thomte, Mazour & Niebergall; Dennis L. Thomte

(57) ABSTRACT

A dosing and/or dispensing system for use with a liquid container such as a bottle or the like for dosing and/or dispensing liquid contents from the bottle. Three different dosing and/or dispensing embodiments are disclosed which enable the liquid to be dosed or dispensed by gravity from the container.

11 Claims, 15 Drawing Sheets

DOSING AND/OR DISPENSING SYSTEM

CROSS-REFERENCE TO RELATED APPLICATION

This is a continuation-in-part application of Petitioner's earlier application Ser. No. 10/685,549 filed Oct. 15, 2003, entitled A DISPENSING SYSTEM which is a continuation-in-part application of Petitioner's earlier application Ser. No. 10/372,375 filed Feb. 22, 2003, entitled CLOSED LOOP DISPENSING SYSTEM, which is a continuation-in-part application of Petitioner's earlier application Ser. No. 10/074,469 filed Feb. 12, 2002 now abandoned, entitled CLOSED LOOP DISPENSING SYSTEM WITH METERING ORIFICE.

BACKGROUND OF THE INVENTION

1. Field of the Invention

The invention disclosed in Petitioner's earlier application Ser. No. 10/685,549 filed Oct. 14, 2003, relates to a dispensing system, which may be either an open loop or closed loop dispensing system, and more particularly to a dispensing system for dispensing corrosive liquid chemicals or dangerous medical liquid products which are typically drawn from the upper end of a container, such as a bottle or the like, to a mixing machine or the like. In that invention, the container is inverted with the liquid product gravity flowing from the lower end thereof. Further, the dispensing system of that invention provides a means for venting the container during shipment or storage in those situations where the liquid within the container requires venting. In the instant invention, three dosing and/or dispensing embodiments are disclosed which are ideally suited for use with portions of the invention of Ser. No. 10/685,549 filed Oct. 14, 2003.

2. Description of the Related Art

Corrosive liquid chemicals and dangerous medical liquid products are typically contained in a container such as a bottle or the like and are frequently dispensed therefrom to a mixing machine. Normally, a cap is placed on the bottle with a dip tube extending therefrom downwardly into the interior of the bottle for drawing the liquid upwardly thereinto. Normally, a dispensing tube extends from the cap to a mixing machine or some other piece of equipment which creates suction in the dispensing tube to draw the liquid from the interior of the bottle. In some prior art devices, when the suction or vacuum is removed from the dispensing tube, backflow may occur. Further, when the cap is removed from the bottle, backflow from the dispensing tube may also occur. Additionally, when the cap is removed from the bottle, liquid residue in the bottle may spill therefrom. Additionally, the conventional prior art systems normally do not prevent the re-use of the bottle which is prohibited in some cases. Yet another disadvantage of the prior art is that a reliable and efficient venting means for the bottle is not normally provided for relieving vacuum pressure from within the bottle. The system of co-pending application Ser. No. 10/372,375 solved the problems associated with the prior art devices or systems.

While the system of co-pending application Ser. No. 10/372,375 works extremely well when the container is in its normal upright condition, the system may not perfectly function when the container of the co-pending application is inverted. When the container or bottle of co-pending application Ser. No. 10/372,375 is inverted, the liquid in the container is drawn or discharged from the normal upper end of the container but which is the lower end of the container in the inverted position. In such a position, the venting membrane, which would normally permit ambient air to replace the liquid in the container as the liquid is discharged from the container, may become "clogged" due to the liquid coming into contact therewith and crystallizing thereon. If air is not permitted to enter the container as the liquid is drawn therefrom, a partial vacuum is created in the upper end of the inverted container which will interfere with the discharge of the liquid therefrom.

The system of co-pending application Ser. No. 10/372,375 solved the problems of the prior art and represented an improvement in the invention of co-pending application Ser. No. 10/074,469. The invention of application Ser. No. 10/685,549 filed Oct. 14, 2003, represents an improvement over the invention described in co-pending application Ser. No. 10/372,375. The instant invention represents an improvement over the invention described in co-pending application Ser. No. 10/685,549 filed Oct. 14, 2003.

SUMMARY OF THE INVENTION

This invention relates to a dispensing system for use with a container, such as a bottle or the like, having an outlet opening formed in the upper end thereof. A cap is removably mounted on the container for selectively closing the outlet opening during shipment and storage. In use, the container is positioned in an inverted position. The lower end of the inverted container has a hollow throat extending downwardly therefrom which has interior and exterior surfaces. A throat plug assembly, having upper and lower ends, is positioned in the throat of the container. The throat plug assembly includes a hollow cylindrical plug member having an open upper end, an open lower end, and a cylindrical wall portion extending therebetween. A tube support is positioned on the open upper end of the plug member. A hollow tube, having upper and lower ends, is secured to the tube support so that its lower end is positioned below the tube support within the plug member. The open lower end of the plug member defines a valve seat. A valve assembly or means is movably positioned within the plug member and includes a normally closed valve and a hollow valve stem extending upwardly therefrom. The hollow valve stem is slidably mounted on the hollow tube which is secured to the tube support. The valve is movable between open and closed positions. The valve, when in its closed position, seats upon the valve seat to close the open lower end of the plug member. A spring is provided in the plug member which is in engagement with the valve means to yieldably urge the valve to its closed position. The valve, when in its closed position, prevents liquid within the container from flowing therefrom. The valve, when in its open position, permits liquid within the container to flow therethrough. At least one of the tube support, cylindrical wall portion or valve stem has a passageway formed therein. The throat plug assembly, when the valve is in its open position, permits liquid in the container to flow therefrom through the passageway, around the valve and outwardly through the valve seat. The throat plug assembly, when the valve is in its open position, permits air to enter the container by passing through the valve seat, around the valve and through the passageway.

When the container contains liquids that require venting during storage or shipment, the throat plug assembly is designed in such a way so as to cooperate with the container cap so that the valve is slightly unseated so that pressure within the container may be vented through the throat plug assembly and through an opening formed in the cap. The valve permits vapor pressure to pass therethrough but prevents liquid from passing therethrough.

The instant invention involves three dosing and/or dispensing embodiments which may be used with portions of the invention described in application Ser. No. 10/685,549 filed Oct. 14, 2003, and illustrated in FIGS. 1–10 hereof. FIGS. 11–12 illustrate a lever operated, gravity flow control assembly which may be mounted on the reservoir of FIGS. 1–10. FIGS. 13–14 illustrate an embodiment which may be mounted on the reservoir of FIGS. 1–10. FIGS. 15–16 illustrate an embodiment including a modified form of the valve actuator.

It is therefore a principal object of the invention to provide an improved dispensing system for corrosive or dangerous liquids contained in a container such as a bottle or the like, when the container is positioned in an inverted condition.

A further object of the invention is to provide a dispensing system which includes a throat plug positioned in the outlet opening of the container with the throat plug being designed so that it will permit vapor pressure within the container to be vented therethrough when the container is being stored or transported.

Still another object of the invention is to provide an improved dispensing system of the type described which permits sufficient air to enter the interior of the container to replace the liquid being dispensed therefrom so that vapor locks are prevented.

Still another object of the invention is to provide a dispensing system which is safe and convenient to use.

Yet another object of the invention is to provide dosing and/or dispensing systems representing an improvement in the prior art.

Yet another object of the invention is to provide a dispensing system which is reliable in use.

These and other objects will be obvious to those skilled in the art.

DETAILED DESCRIPTION OF THE INVENTION

FIGS. 1–10 illustrate the invention of the co-pending application Ser. No. 10/685,549 filed Oct. 14, 2003. The following description with respect to FIGS. 1–10 is found in the co-pending application and is repeated herein to complete the description of the instant claimed invention.

Figure 1:
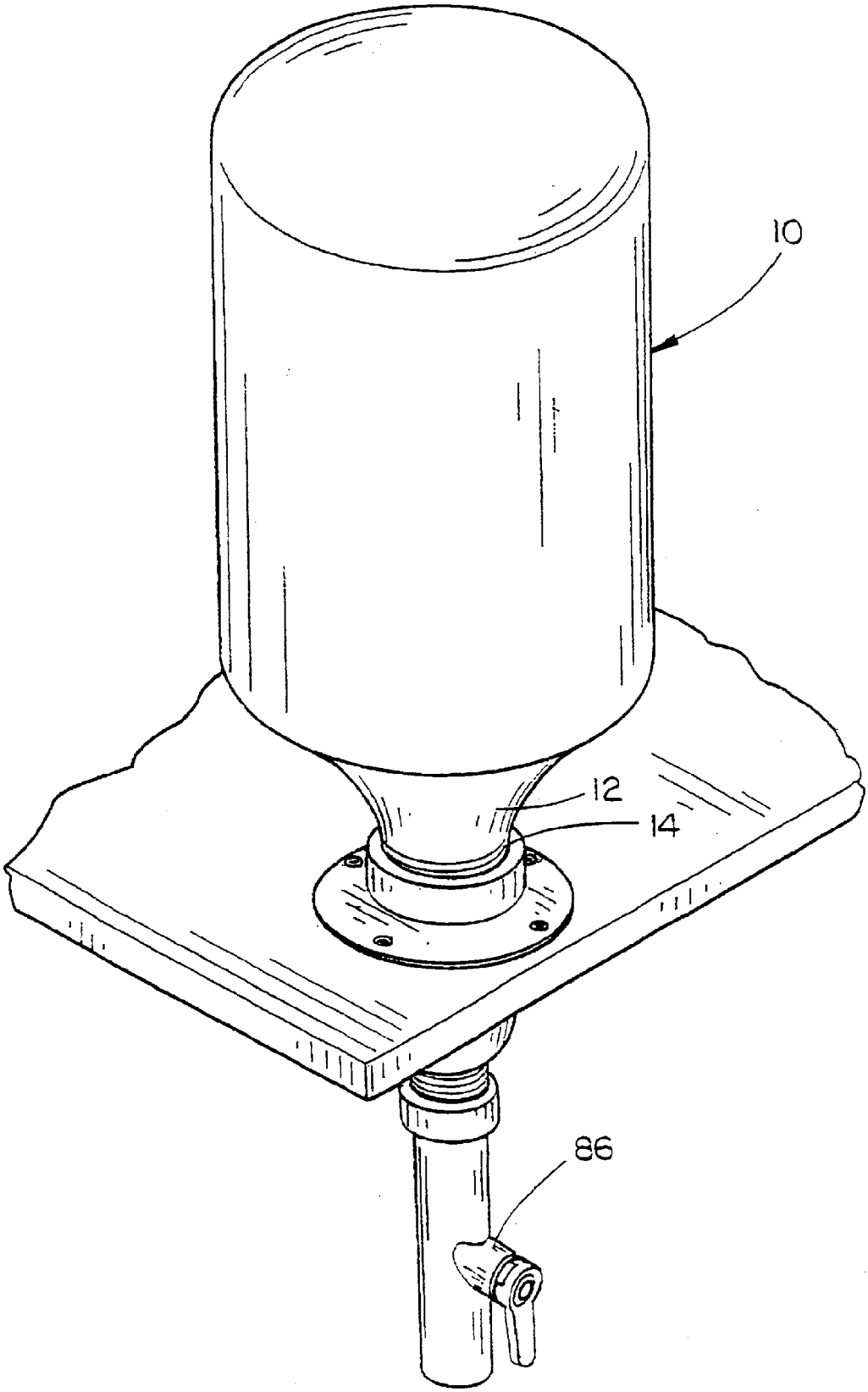
FIG. 1 is a perspective view of a container in an inverted position so as to dispense liquids.
Figure 3:
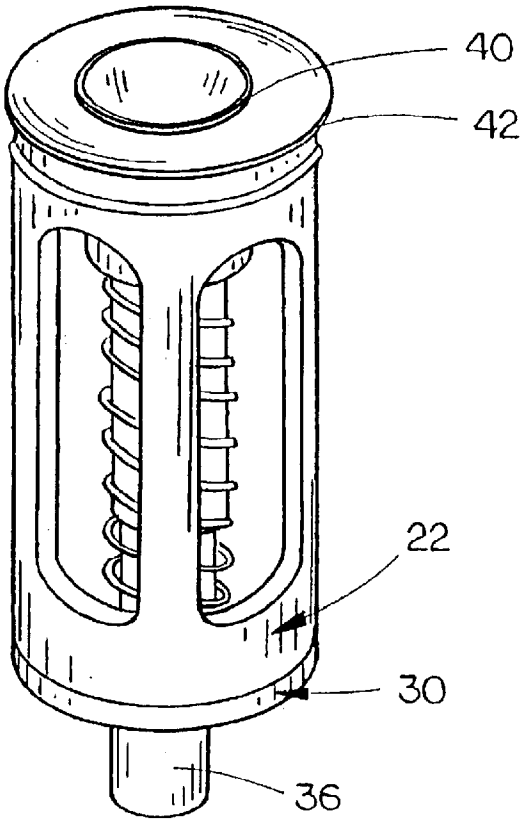
FIG. 3 is a perspective view of the throat plug assembly with the throat plug assembly being illustrated in the position when the container is in its upright condition.

In FIGS. 1–10, the numeral 10 refers to a conventional container such as a bottle or the like which is used for transporting, storing and dispensing liquids therefrom. FIG. 1 illustrates the container 10 in an inverted dispensing position. Container 10 includes a hollow throat portion 12 extending downwardly therefrom and which has external threads 14 mounted thereon.

Figure 2:
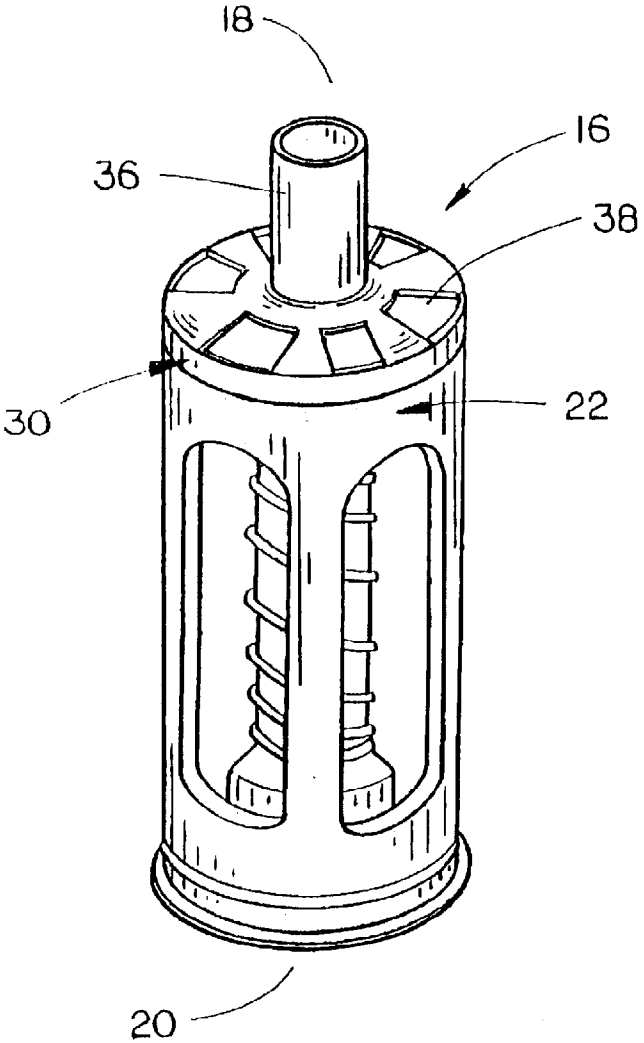
FIG. 2 is a perspective view of a throat plug assembly illustrating the throat plug in the position when the container is inverted.
Figure 4:
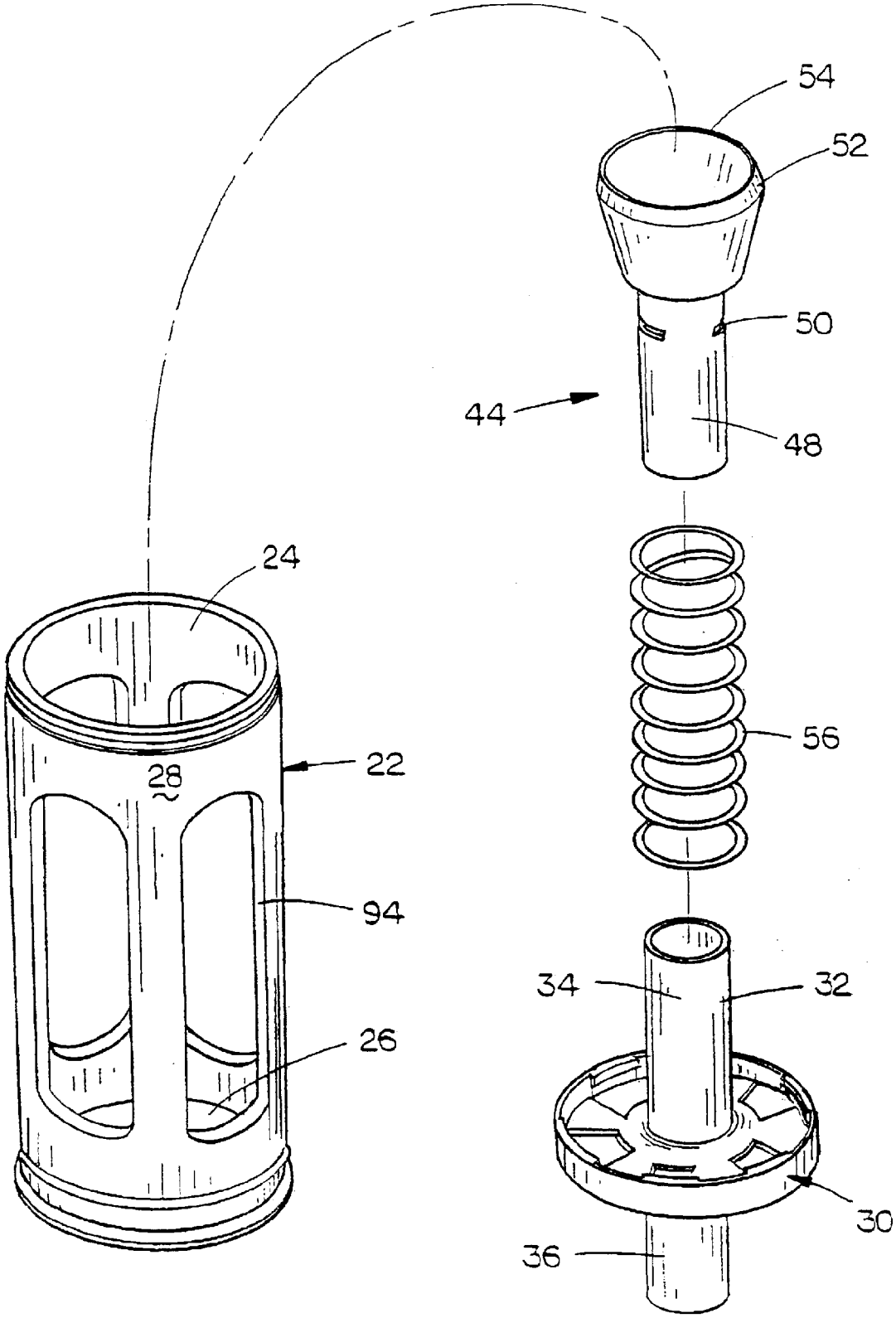
FIG. 4 is an exploded perspective view of the throat plug assembly of FIG. 2.

The numeral 16 refers to a throat plug assembly which will be described as it is positioned when the container 10 is in the inverted position. The throat plug assembly 16 is inserted into the hollow throat portion 12 of the container 10 while the container 10 is in its upright position. For purposes of description, throat plug assembly 16 will be described as including an upper end 18 and a lower end 20. The lower end 20 of the throat plug assembly 16 includes a hollow cylindrical plug member 22 having an open upper end 24, an open lower end 26, and a cylindrical wall portion 28 extending therebetween. A disk-like tube support 30 is detachably mounted on the upper end of the cylindrical wall portion 28, preferably by means of a snap-fit connection. Tube support 30 includes a tube 32 having a lower end portion 34 and an upper end portion 36. As seen in the drawings, lower end portion 34 extends downwardly from tube support 30 and upper end portion 36 extends upwardly from tube support 30. In some cases, upper end portion 36 will not be needed. In some cases, a flexible tube (not shown) will be secured to the upper end of upper tube portion 36 so as to extend upwardly into the container 10, if so required. As seen in FIG. 2, tube support 30 has a plurality of spaced-apart passageways 38 formed therein.

Figure 5:
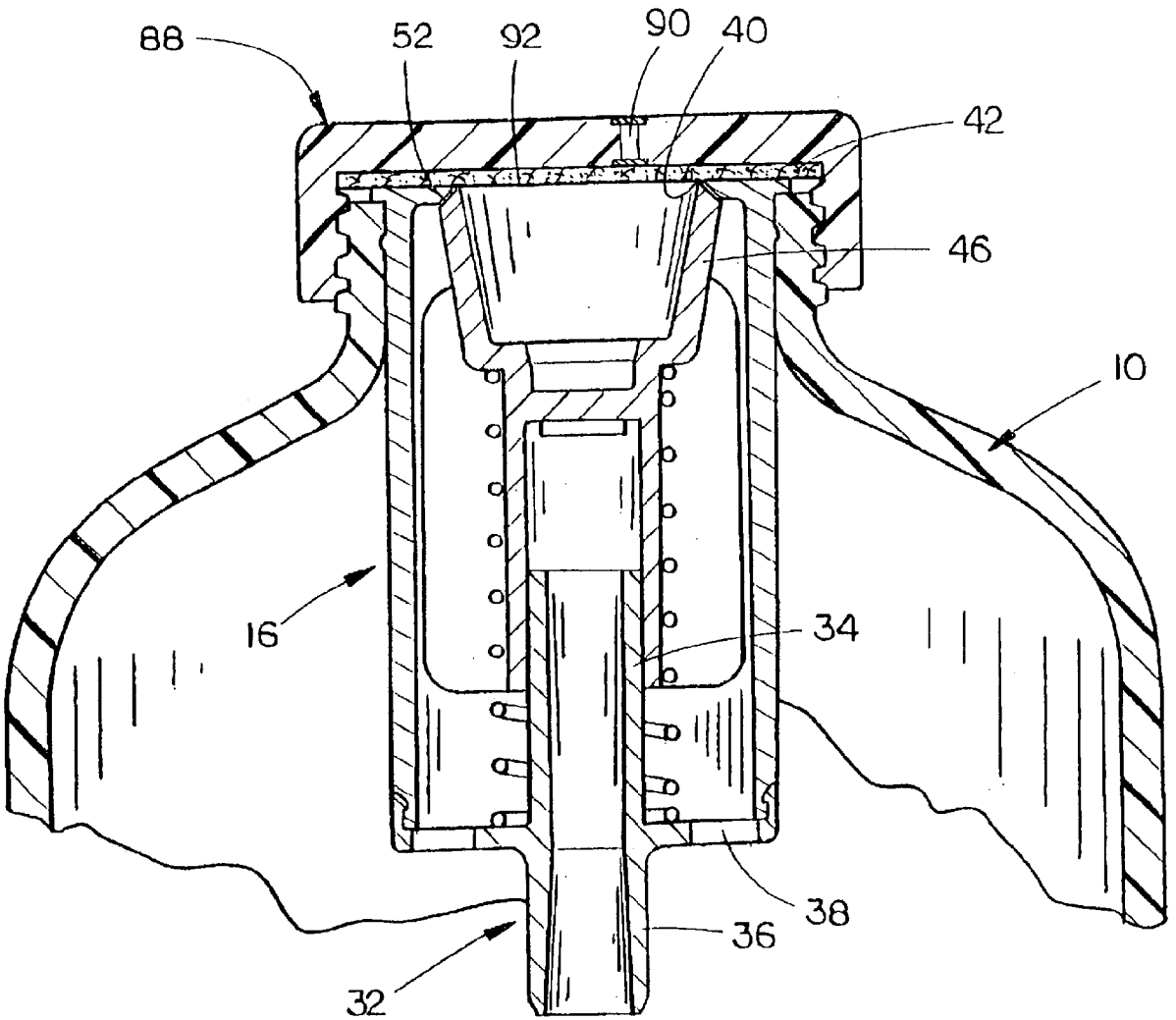
FIG. 5 is a partial vertical sectional view of the container in an upright condition illustrating the manner in which the throat plug assembly and cap permit venting of vapor pressure within the container.
Figure 6:
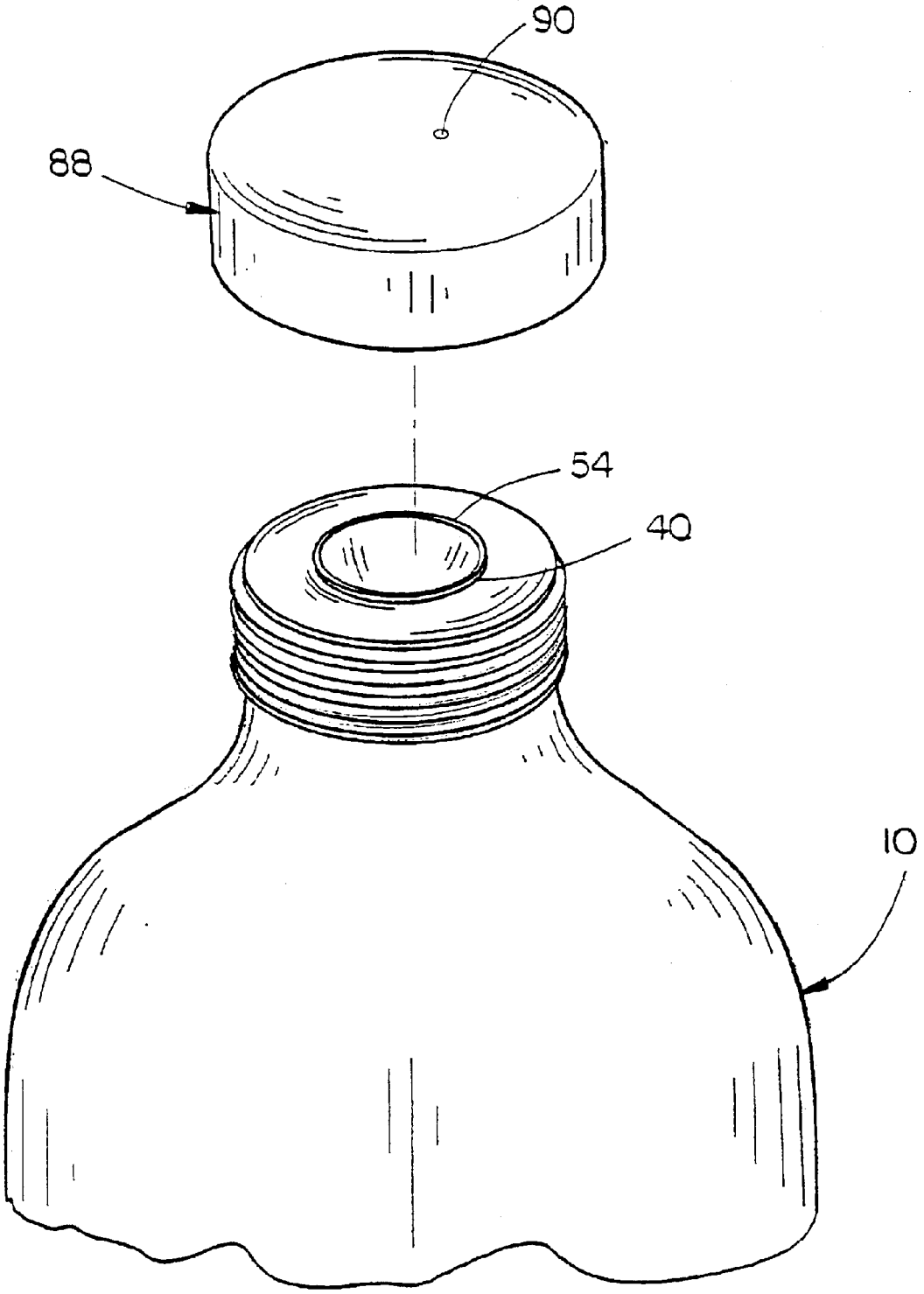
FIG. 6 is a partial exploded perspective view of the container and cap in an upright condition.

The lower end of the plug member 22 defines a centrally located opening which defines a valve seat 40. The lower end of plug member 22 also has an outwardly extending lip portion 42 which is designed to engage the upper end of the container 10, as seen in FIG. 5, to limit the downward movement of the throat plug assembly 16 with respect to container 10 when the throat plug assembly 16 is inserted downwardly into the container 10 while the container is in its upright position (FIG. 5).

Figure 9:
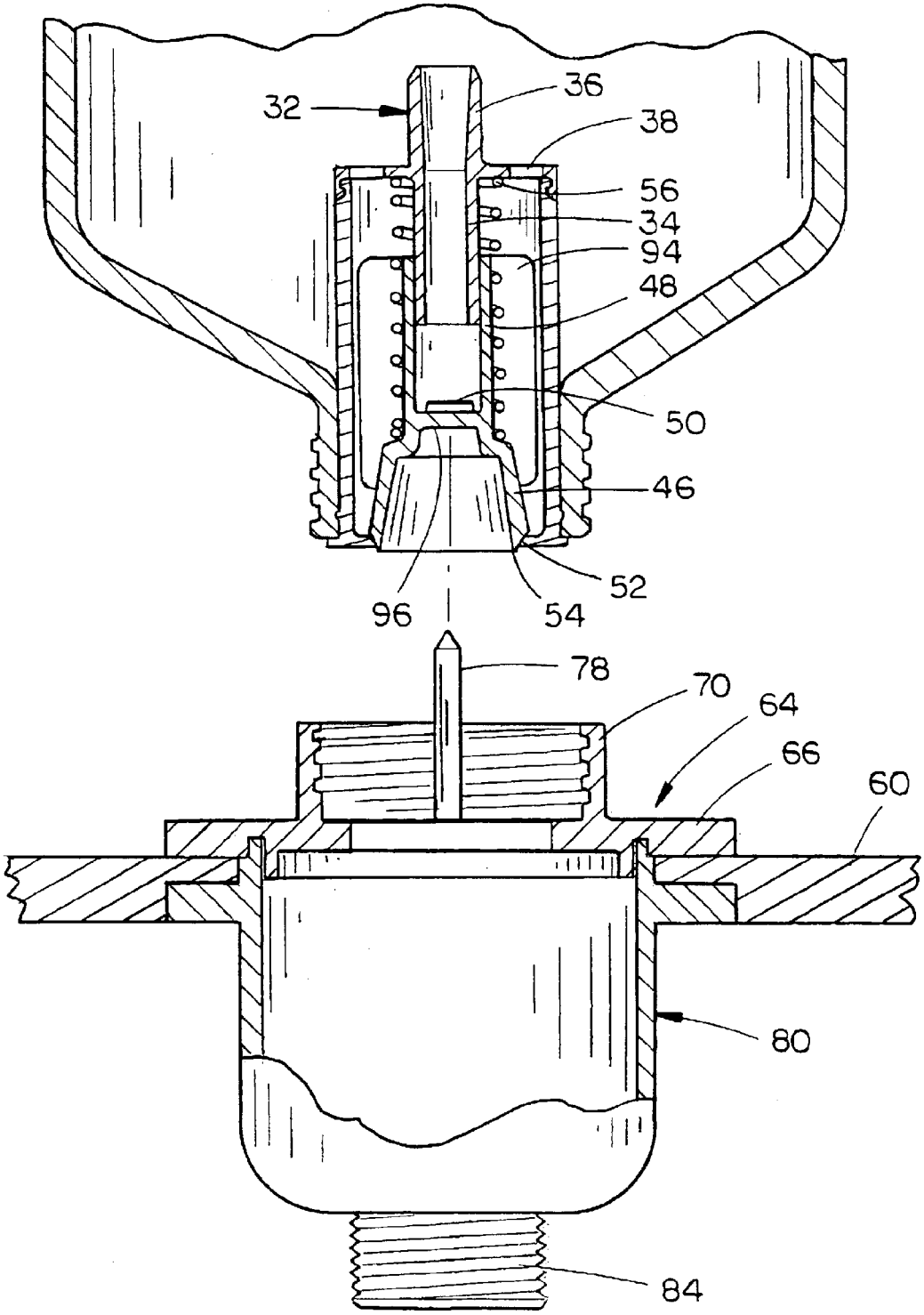
FIG. 9 is a vertical sectional view of the apparatus of FIG. 8.
Figure 10:
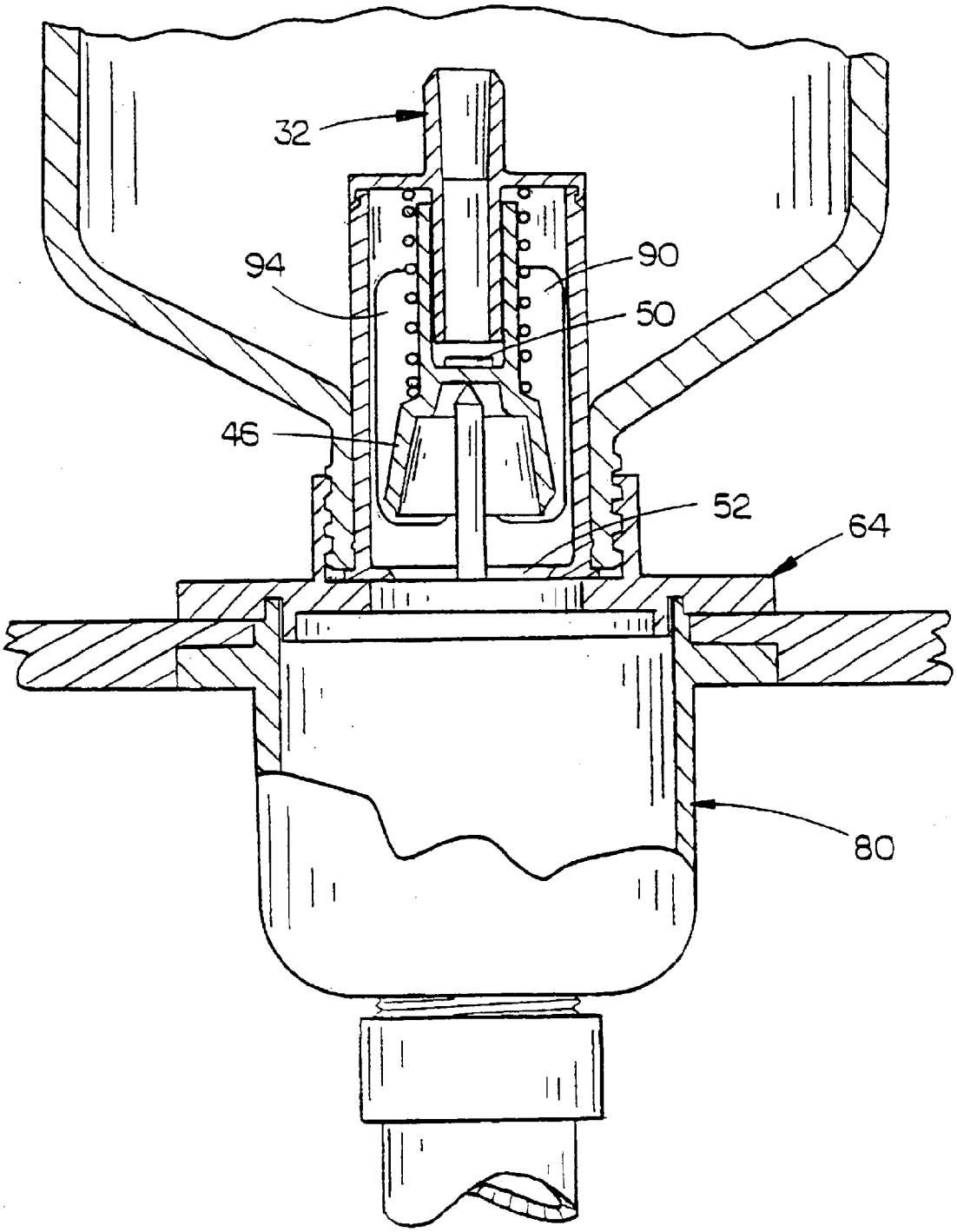
FIG. 10 is a view similar to FIG. 9 except that the container has been mounted on the receptacle at the dispensing location.

The numeral 44 refers generally to a valve means which is movably positioned within the plug member 22 and which includes a normally closed valve 46 and a hollow valve stem 48 extending upwardly therefrom. Valve stem 48 includes one or more passageways 50 extending therethrough. Valve 46 includes a tapered portion 52 at it lower end which terminates in a lower end portion 54. In those cases where the container contains liquids requiring venting during storage or shipment, the lower end portion 54 will protrude slightly downwardly from the lower end of plug member 22, a illustrated in FIG. 9. Valve stem 48 slidably receives the lower end of lower end portion 34 of tube 32, as illustrated in FIG. 9. Spring 56 embraces valve stem 48 and lower end portion 34 to yieldably urge valve 46 to its lower closed position.

Figure 7:
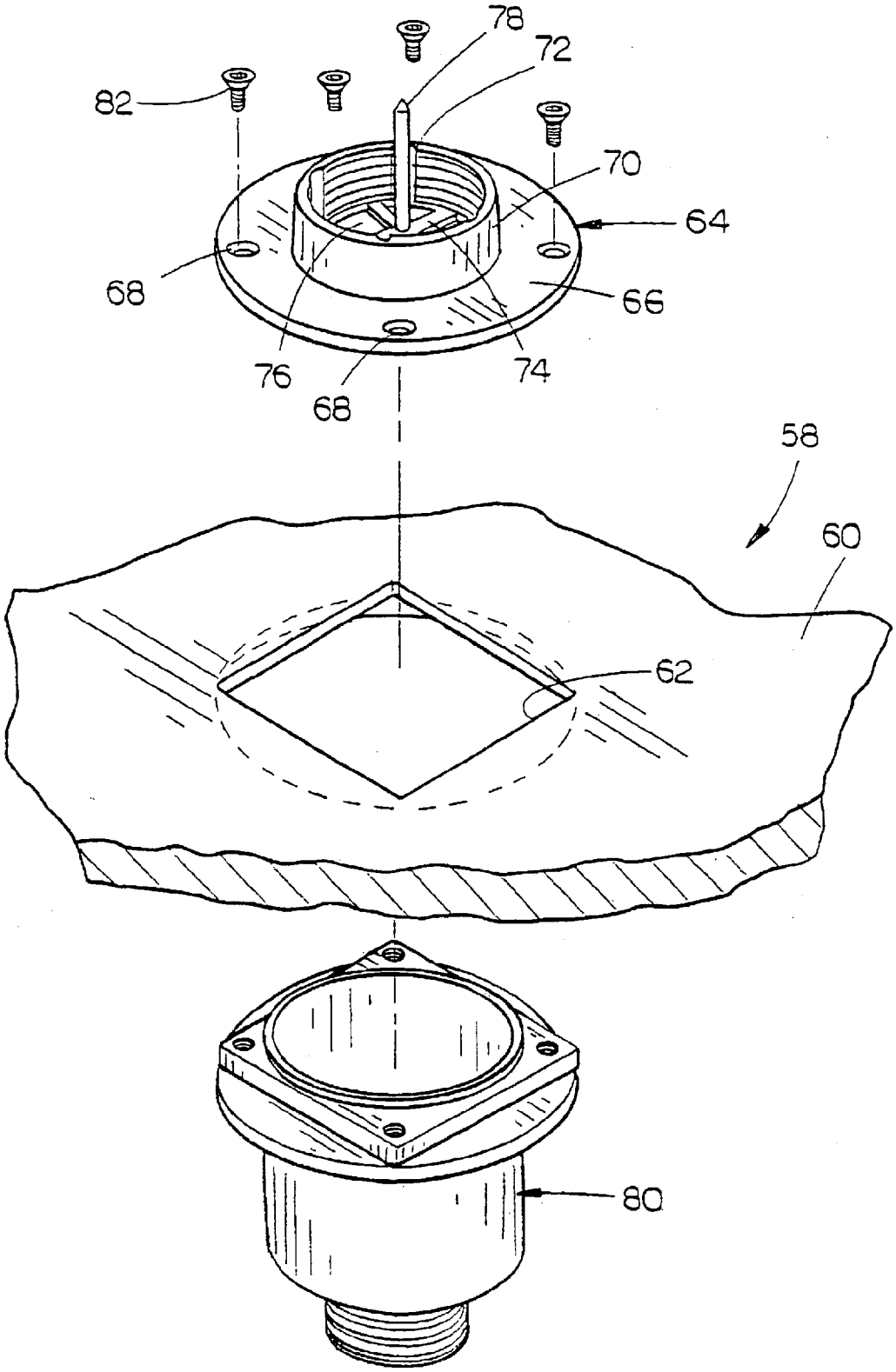
FIG. 7 is an exploded perspective view of one means of mounting the inverted container at a dispensing location.
Figure 8:
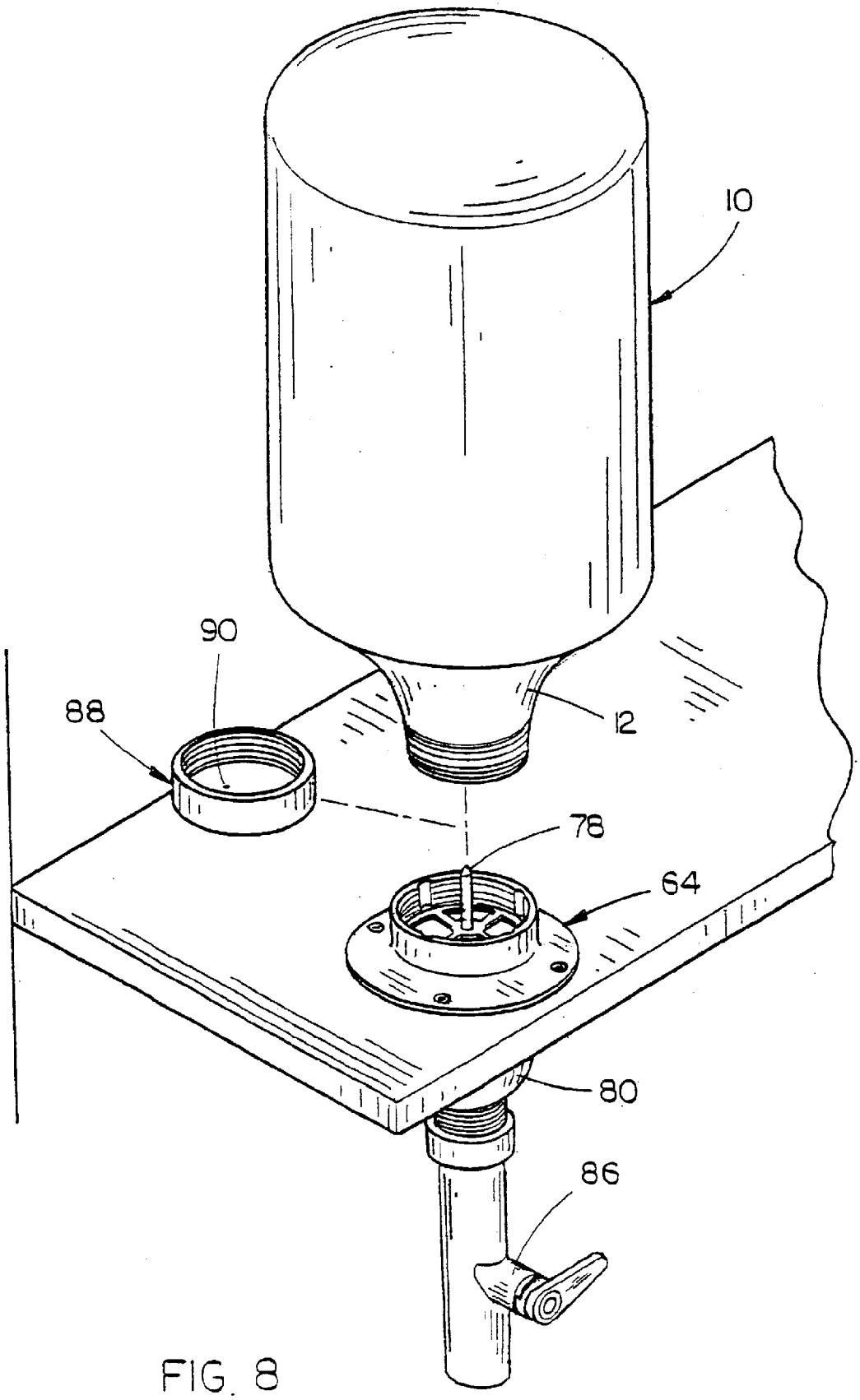
FIG. 8 is an exploded perspective view illustrating an inverted container and its relationship to the structure of FIG. 7.

FIGS. 7–9 illustrate portions of a dispensing station which is referred to generally by the reference numeral 58. Dispensing station 58 may be located within a cabinet or simply upon a horizontally disposed board or shelf 60 having an opening 62 formed therein. Included at the dispensing station 58 is a upper fixture 64 which includes a flange 66 having screw or bolt openings 68 formed therein. The fixture 64 includes an upwardly extending internally threaded stub 70. The interior of pipe stub 70 is provided with a plurality of longitudinally extending grooves or passageways formed therein. At the lower inner end of stub 70 are a plurality of support arms 74 which extend across the opening 76 and which have an actuator rod 78 secured thereto and extending upwardly therefrom.

A lower fixture 80 is positioned below the shelf and within the shelf 60, as illustrated in FIGS. 7 and 9. Screws 82 secure the fixtures 64 and 80 together, as seen in FIG. 7. Preferably, the lower end of fixture 80 includes an externally threaded throat portion 84 for dispensing liquid therethrough to a on-off valve 86 or other dispensing or metering device.

When the container 10 is being used to store, transport or dispense liquids which require venting during the shipment or storage thereof, the container 10 will include a vented cap 88 having a vent opening 90 formed therein, the lower end of which is closed by a membrane 92 which permits air to pass therethrough but does not pass liquid to pass therethrough. When the cap 88 is screwed onto the container 10, the membrane 92 will engage the end 54 of valve 46 to slightly open valve 46, as illustrated in FIG. 5, to permit air to be vented from the bottle while preventing liquid from being discharged from the bottle. When valve 46 has been slightly unseated, as illustrated in FIG. 5, vapor pressure within the container 10 may pass through the passageways or openings 94 formed in cylindrical wall member 28 and thence through the opening between the tapered surface 52 of valve 46 and the valve seat 52 and thence through the membrane 92 outwardly through the opening 90. When the throat plug assembly of this invention is not going to be used in situations where it is necessary to vent vapor pressure from the container during shipment or storage, there is no need for the end portion 54 of tapered portion 52 to be included. In that situation, the valve 46 will positively close the valve seat 40. Regardless of whether the end portion 54 is utilized or not, when the cap 88 is removed from the container 10, the valve 46 will close the valve seat 52. The container 10 is then inverted with the external threads 14 of the container 10 being threadably engaged with the internal threads on the stub 70. As the container 10 is threadably mounted into the fixture 64, the actuator rod 78 engages the valve means 44 at 96 which will cause the valve 46 to unseat from the valve seat 52. Although the fixture 64 is shown as including internal threads to effect the connection between the container and the fixture, a push-pull connection could also be utilized. Such a connection is commonly referred to as a snap-in connection.

When it is desired to dispense the liquid from the container 10 into a receptacle, tub, container, etc., the valve 86 is opened to permit liquid to flow through the passageways 94, passageways 50, and through the valve seat 52, through the fixture 64, through fixture 80, and outwardly through the valve 86. Air is permitted to enter the interior of the container 10 to prevent air locks therein during the dispensing of liquids by permitting ambient air to pass downwardly through the passageways 72 in stub 70, thence through passageways 94, passageways 50, and upwardly through the passageway 36 and also through the tube 32 into the interior of the container. Although it is preferred that all of the passageways 50, 94 and 38 be utilized, in some situations it may be only necessary to use the passageways 38 or it may only be necessary to utilize the passageways 94 or it may be only necessary to utilize the passageways 50. If the liquid is very viscous, it may be advantageous to insert a flexible tube onto the upper end of upper end portion 36 so that air passing through the tube 32 will be able to pass through the viscous liquid to the upper end of the container.

Thus the dispensing system of FIGS. 1–10 may be utilized to vent containers or it may be used where venting is not required. The system of FIGS. 1–10 is extremely economical and provides for a continuous gravity flow due to the fact that ambient air can enter the interior of the container to replace the liquid being dispensed therefrom. The dispensing system of FIGS. 1–10 eliminates any possibility of a vapor lock and provides a positive shut-off.

Figure 11:
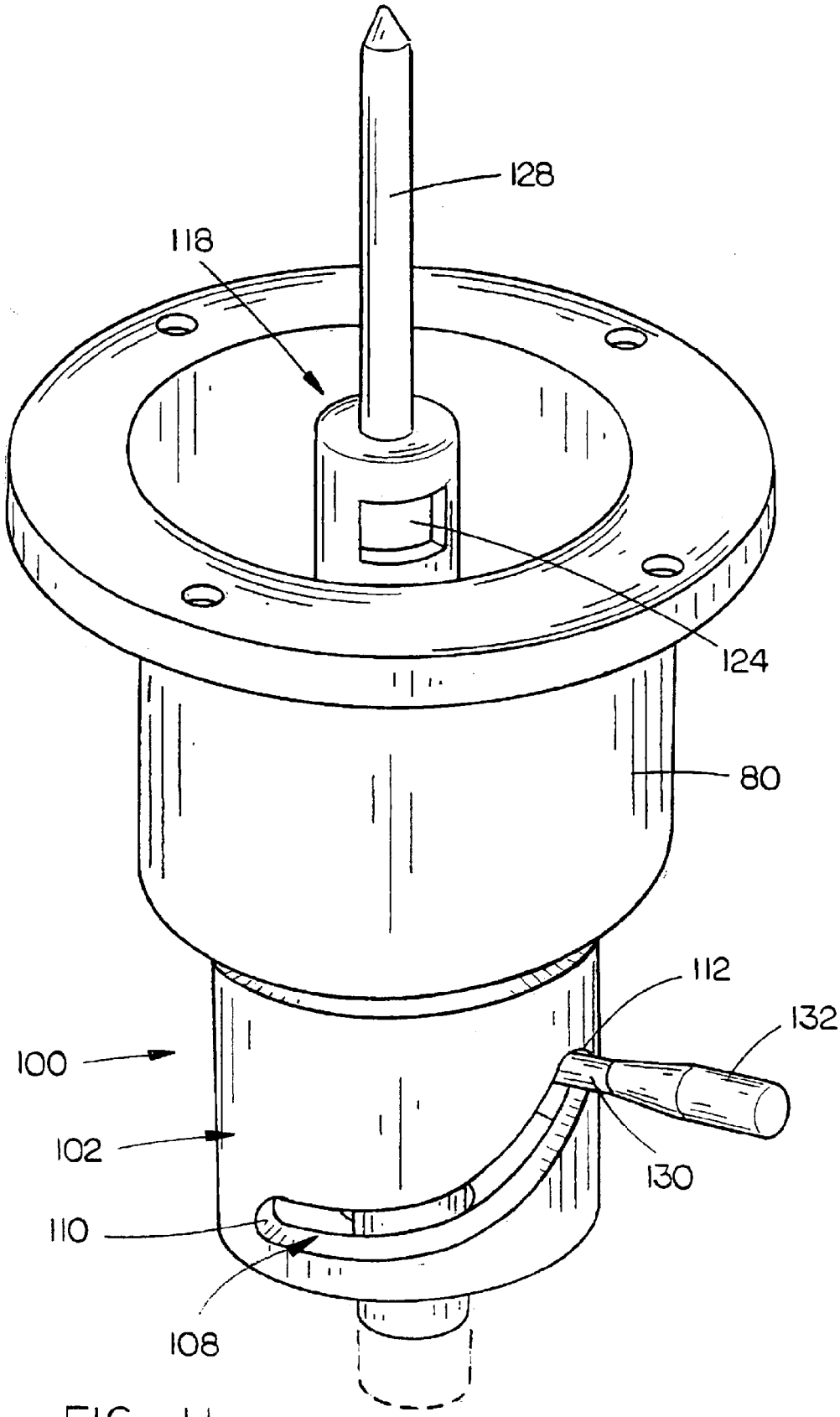
FIG. 11 is a perspective view illustrating a lever operated, gravity flow control assembly for use with the reservoir of FIG. 7.
Figure 12:
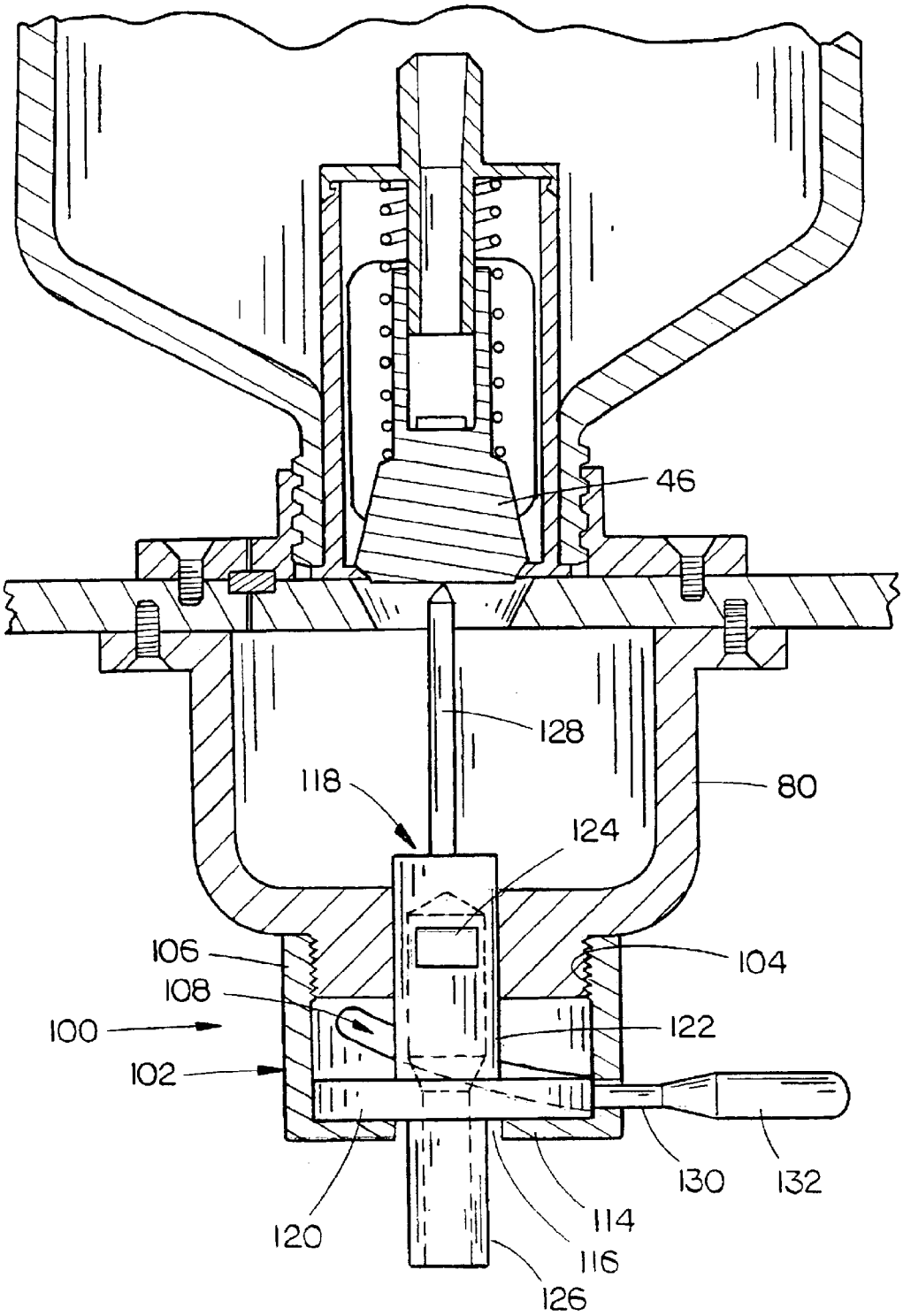
FIG. 12 is a vertical sectional view illustrating the assembly of FIG. 11 mounted on the reservoir of FIG. 7.

FIGS. 11 and 12 illustrate a lever operated, gravity flow control assembly 100 which may be mounted on the reservoir 80 of FIGS. 1–10. Assembly 100 includes a hollow, cup-shaped housing 102 including an internally threaded upper end 104 which is threadably secured to the lower end of the reservoir 80. Housing 102 includes a cylindrical wall 106 which has an arcuate cam track 108 formed therein which has a lower end 110 and an upper end 112. Housing 102 also includes a bottom wall 114 which has a central opening 116 formed therein.

The numeral 118 refers to a valve actuator assembly which is selectively vertically and rotatably mounted in housing 102 and which extends upwardly through reservoir 80. Assembly 118 includes a disc-shaped member 120 which movably sealably engages the inside surface of wall 106. A hollow tube 122 extends upwardly from member 120 and has one or more openings 124 formed in the wall surface thereof. The inner lower end of tube 122 is in fluid communication with tube 126 which extends downwardly from member 120. Normally, a bottle or the like will be secured to tube 126 to facilitate the flow of liquid from the container into the bottle or the like. However, the tube 126 itself may be used to transfer the fluid into any suitable receptacle. Actuator stem 128 extends upwardly from the upper end of tube 122 through reservoir 80 for selective engagement with the valve 46 to open the same. Lever 130 is secured to the member 120 and extends outwardly through the cam track 108. Preferably, the outer end of the lever 130 has a knob 132 mounted thereon.

When lever 130 is at the lower end 110 of the cam track 108, the valve 46 is in its fully closed position (FIG. 12). To open valve 46, the lever 130 is moved upwardly along the cam track 108 which causes the actuator stem 128 to move upwardly into engagement with the valve 46 to move the same upwardly to open the same. The lever 130 is selectively rotated to achieve the desired flow rate. When the lever 130 is at the lower end 110 of the cam track 108, the container may be removed from the fixture to replace the same since the valve 46 is in its normally closed position of FIG. 12. The container may be screwed onto the fixture, snapped onto the fixture, or lever locked onto the fixture as desired.

Figure 13:
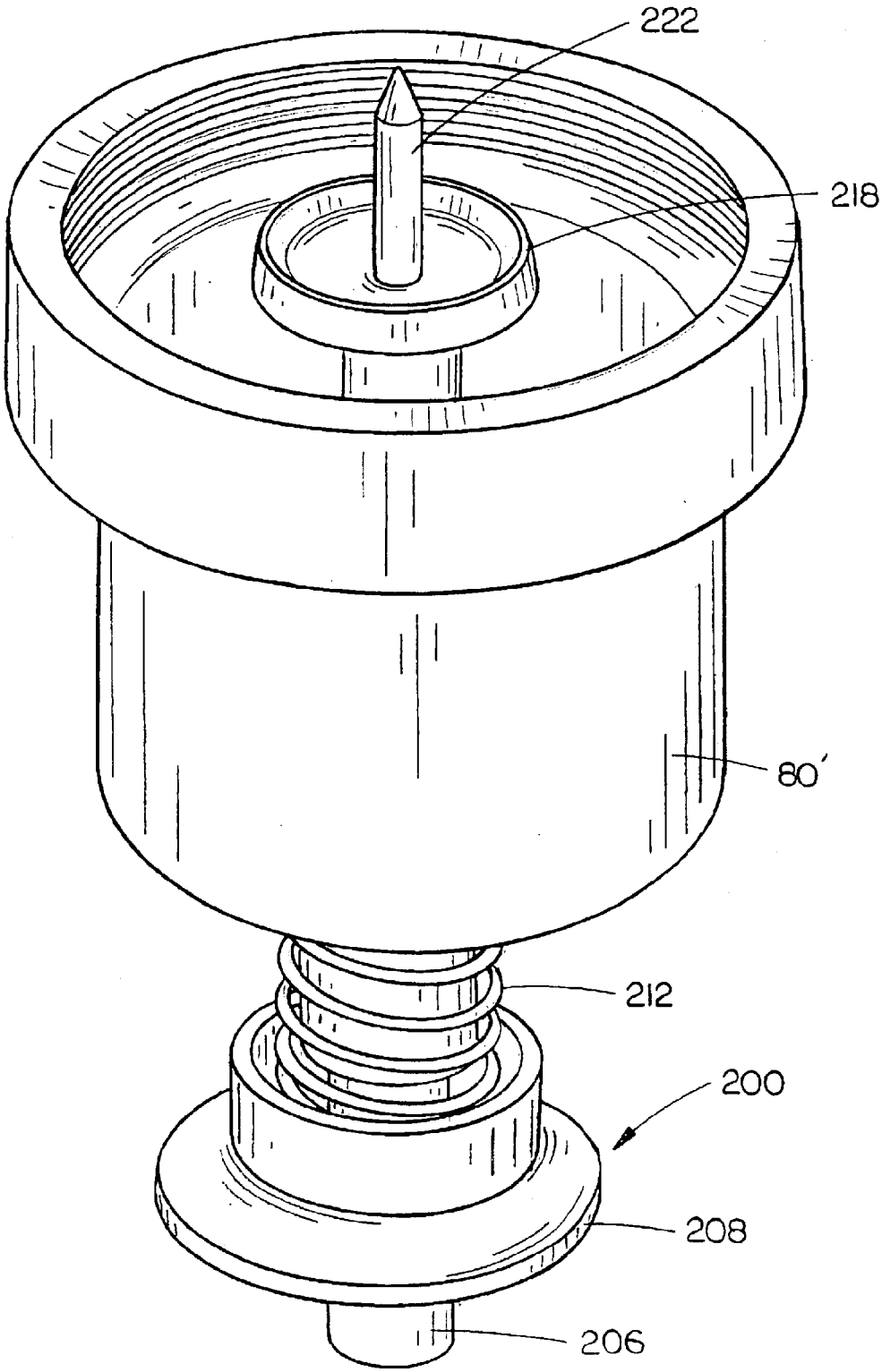
FIG. 13 is a perspective view of a manual dosing dispenser mounted on a reservoir.
Figure 14:
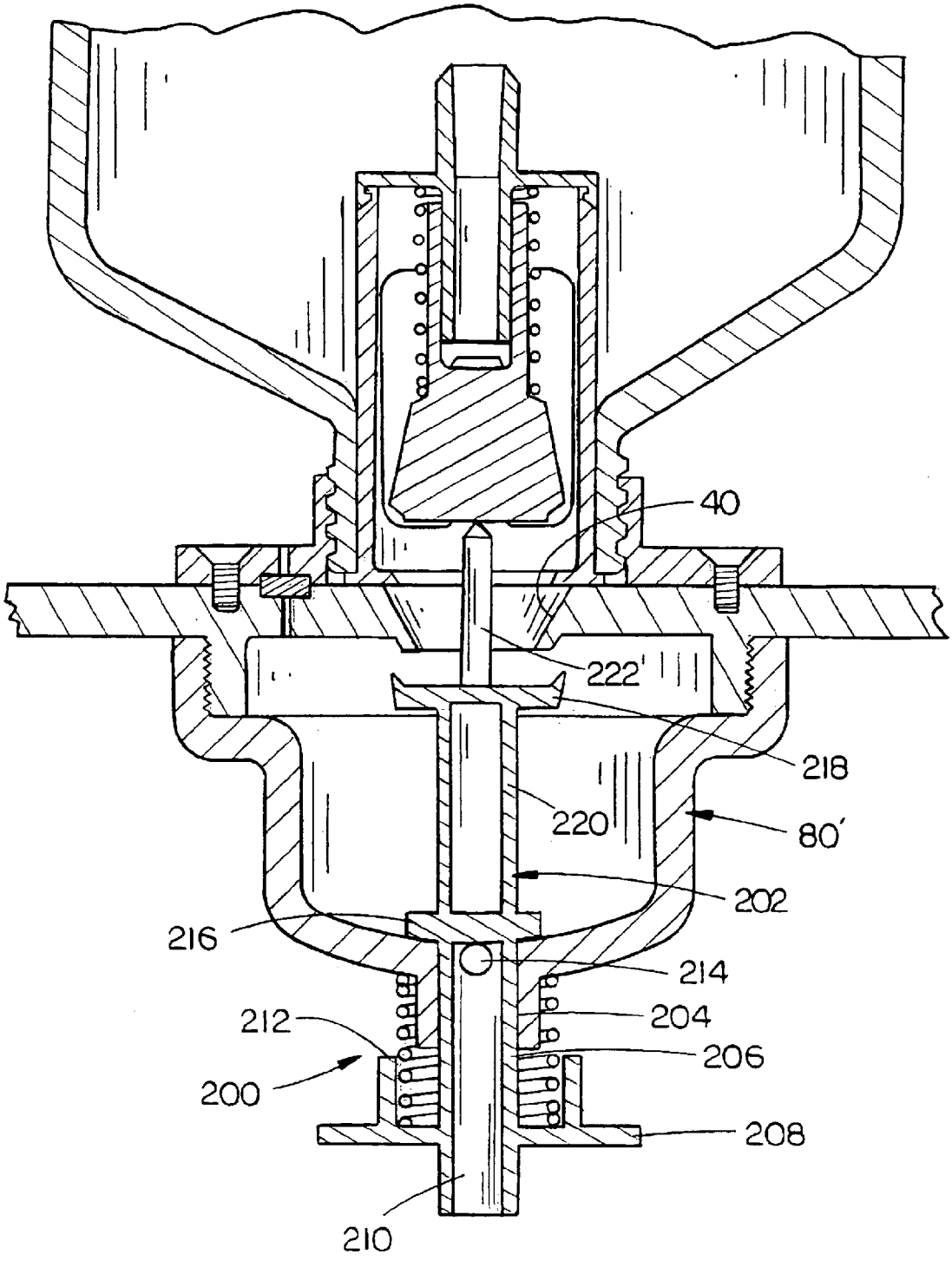
FIG. 14 is a vertical sectional view of the dispenser of FIG. 13.

FIGS. 13–14 illustrate an embodiment wherein structure is mounted on the reservoir 80' to enable the apparatus to function as a manual dosing dispenser. In the embodiment of FIGS. 13 and 14, the reservoir 80' will have a predetermined volume such as one ounce, two ounces, etc. The manual dosing structure is designated by the reference numeral 200. Structure 200 includes an elongated valve actuator 202 which is selectively vertically movable within an opening 204 formed in the bottom of the reservoir. Actuator 202 includes a lower tubular portion 206 which is vertically movably received by the opening 204 and which has a laterally extending disc, flange, fingers, etc. referred to generally by the reference numeral 208. Tubular portion 206 is hollow so as to define a passageway 210 extending therethrough. Spring 212 embraces tubular portion 206 between the bottom of reservoir 80' and disc 208 to normally maintain tubular portion 206 in its lower "closed" position of FIG. 14. Tubular portion 206 is provided with one or more openings 214 formed therein which are sealed by the bottom wall of the reservoir 80' when the tubular member is in its lower position (FIG. 14). Shoulder 216 is provided at the upper end of tubular portion 206 to limit the downward movement of the valve actuator 202.

Valve actuator 202 includes a valve member 218 at the upper end of the tubular portion 220, as seen in FIG. 14. Rod 222 is provided at the upper end of actuator 202 for engagement with the valve 46. When the valve actuator 202 is in its lower position, as seen in FIG. 14, the upper end of rod 222 is preferably in engagement with valve 46, to open the same, to enable liquid in the container to fill the dosing reservoir 80'. The liquid cannot drain from the reservoir at this time due to the fact that the opening(s) 214 are sealed.

Assuming that the reservoir 80' is full with the predetermined volume of liquid and it is desired to dispense the same therefrom into a bottle or the like, the open upper end of the bottle is positioned so that the open lower end of tubular portion 206 is received thereby. Upward movement of the member 208 causes valve 218 to seal or close the lower end of valve seat 40, thereby preventing additional liquid from the inverted container from passing downwardly into the reservoir 80'. At the same time, the liquid in the reservoir 80' may flow therefrom through the opening(s) 214 into and through passageway 210 and into the bottle.

When the predetermined liquid dose has been discharged into the receiving bottle, the member 208 is lowered until shoulder 216 engages the bottom of reservoir 80', which seals opening(s) 214. At that time, liquid from the inverted container can then flow around valve 46 into the reservoir for the next dispensing sequence.

Figure 15:
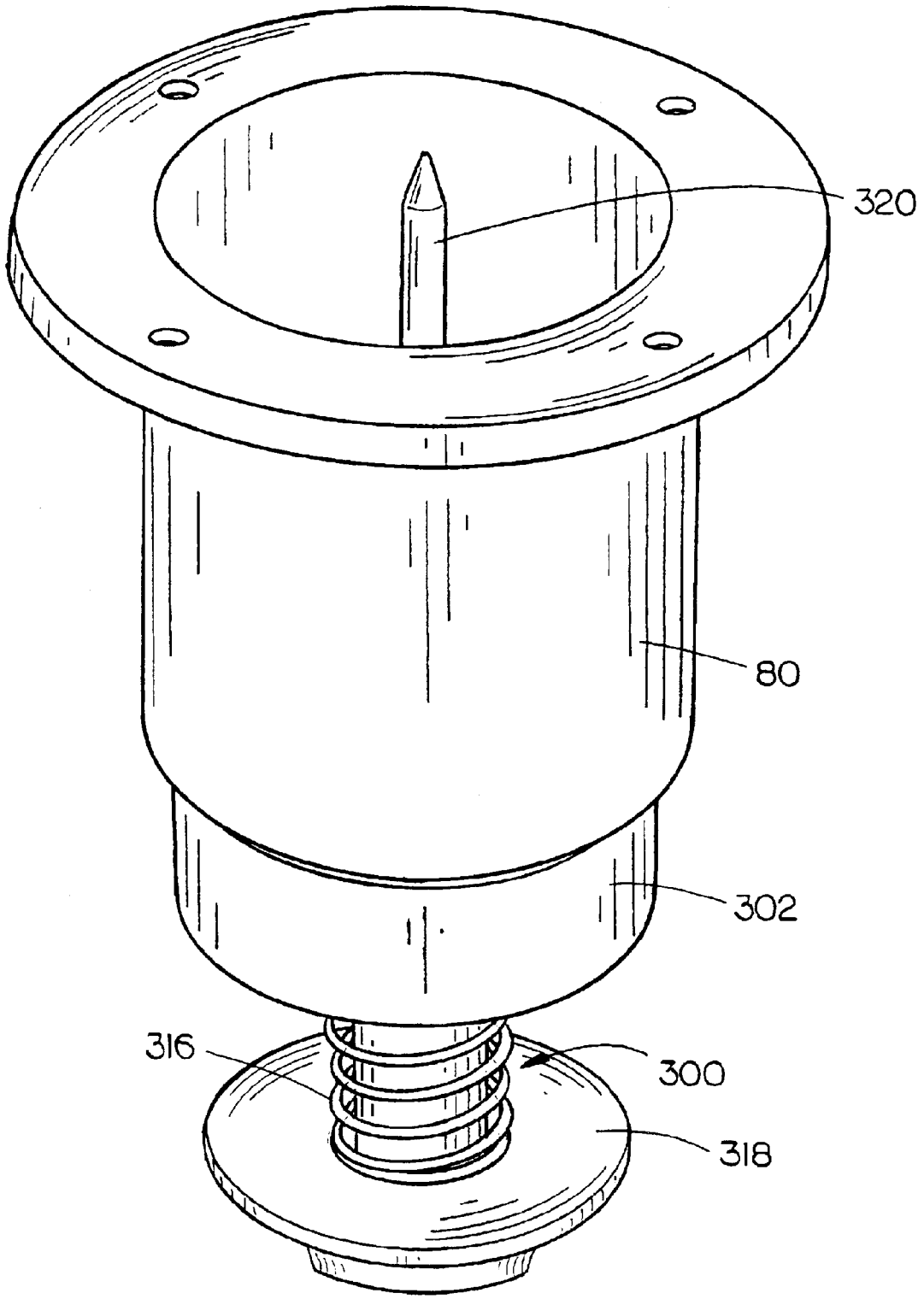
FIG. 15 is a perspective view of another dosing dispenser.
Figure 16:
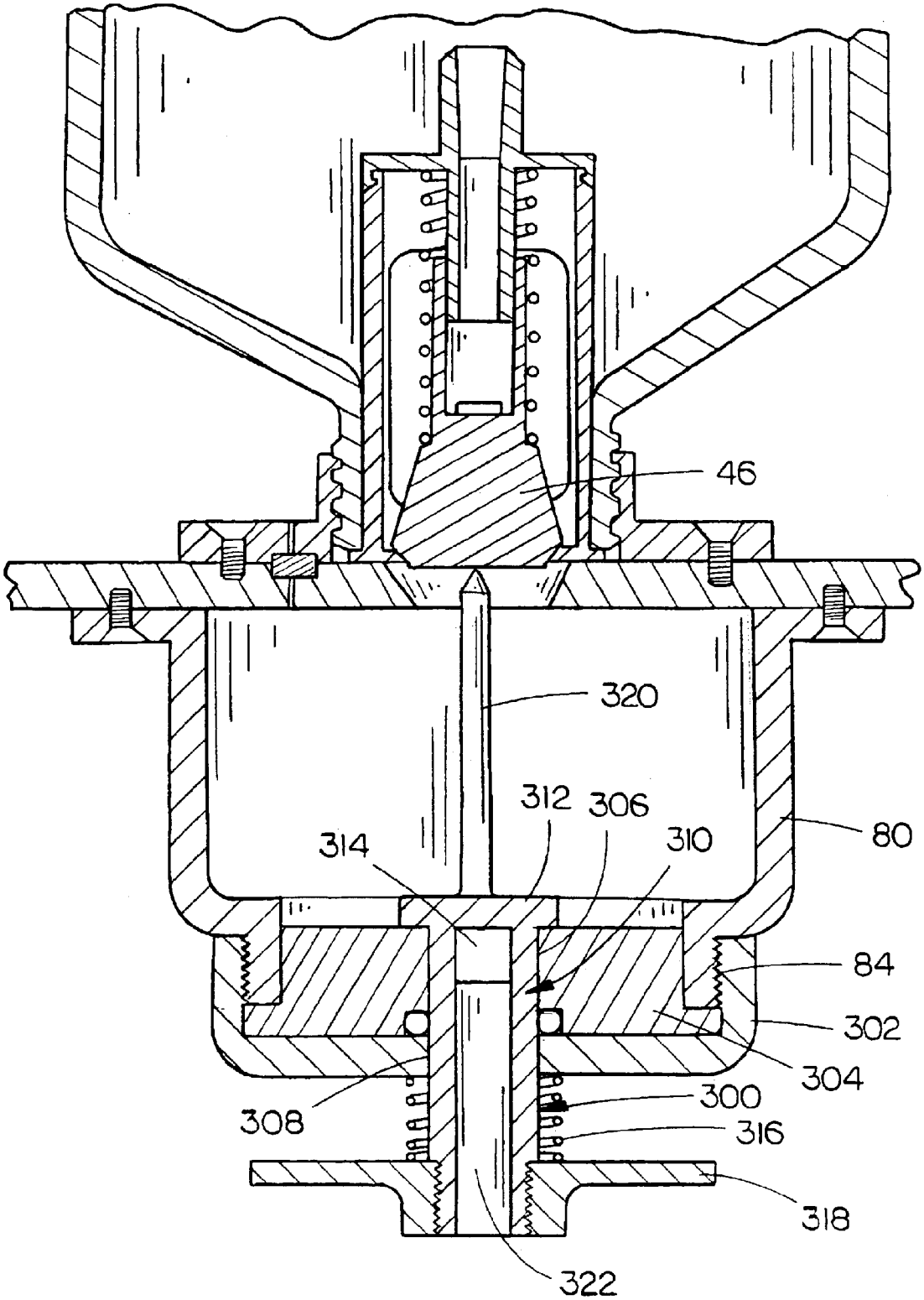
FIG. 16 is a vertical sectional view of the dispenser of FIG. 15.

Another dosing dispenser embodiment is illustrated in FIGS. 15 and 16 and includes a valve actuator assembly referred to generally by the reference numeral 300. Assembly 300 includes a cup-shaped cap 302 which is screwed onto the threads 84 of the reservoir 80. Ring block 304 is positioned with cap 302 and has a central opening 306 formed therein which registers with the opening 308 in cap 302. Hollow tubular member 310 is vertically movably received by openings 306 and 308 and has a shoulder or lift valve 312 provided therein which limits the downward movement of tubular member 310 with respect to ring block 304. Tubular member 310 is provided with one or more openings 314 formed therein which are positioned within ring block 304 when the valve actuator is in its lower "closed" position of FIG. 16. Spring 316 embraces tubular member 310 between the bottom of reservoir 80 and a lift lever 318 secured to the lower end of tubular member 310 to yieldably urge the actuator to its lower position. Rod 320 extends upwardly from lift valve 312 and has its upper end positioned closely to the normally closed valve 46 when in the "closed" position of FIG. 16.

When it is desired to fill a bottle or the like with the liquid from the inverted container, the bottle is placed beneath the lift lever 318 and then raised so that rod 320 raises and unseats valve 46 to enable liquid from the container to flow around valve 46, into reservoir 80, through opening(s) 312 which are now exposed above ring block 304, and downwardly through the passageway 322 into the bottle. The bottle is lowered and removed when the desired liquid level in the bottle has been received. As the bottle is lowered, the lift valve 312 seats upon ring block 304 to prevent further liquid from passing through opening 306. Lowering of the lift lever 318 also causes valve 46 to again close.

Although the invention herein is ideally suited for use with a container mounted on a fixture, the invention herein may be associated with a container which is not mounted on a fixture but which is portable so that the container may be carried from one location to another for use at those locations.

Thus it can be seen that the invention accomplishes at least all of its stated objectives.

I claim:

1. In combination:

a dispensing fixture;

an inverted liquid container having upper and lower ends;

said lower end of said container having a hollow throat extending downwardly therefrom which has interior and exterior surfaces;

said throat of said container being detachably connected to said fixture;

a throat plug assembly having upper and lower ends, positioned in said throat of said container;

a first, normally closed valve movably positioned within said throat plug assembly;

said first valve being movable between open and closed positions;

said first valve, when in its said closed position, seating upon a valve seat;

said first valve, when in its said open position, unseating from said valve seat;

a spring in said throat plug assembly which is in engagement with said first valve to yieldably urge said first valve to its said closed position;

said first valve, when in its said closed position, preventing liquid within the container from flowing therefrom;

said first valve, when in its open position, permitting liquid within the container to flow therethrough;

a flow control assembly, having open upper and lower ends, secured to said fixture below said throat of said container;

said flow control assembly including a selectively vertically movable valve actuator which is selectively movable between upper and lower positions;

said first valve being in its said open position when said valve actuator is in its said lower position;

said valve actuator including a second valve which closes said valve seat when said valve actuator is in its said upper position.

2. The combination of claim 1 wherein said valve actuator is also rotatably movably mounted.

3. The combination of claim 1 wherein said valve actuator has a cam lever secured thereto which is movably positioned within a cam track.

4. In combination:

an inverted liquid container having upper and lower ends;

said lower end of said container having a hollow throat extending downwardly therefrom which has interior and exterior surfaces;

a throat plug assembly having upper and lower ends, positioned in said throat of said container;

a first, normally closed valve movably positioned within said throat plug assembly;

said first valve being movable between open and closed positions;

said first valve, when in its said closed position, seating upon a valve seat;

said first valve, when in its said open position, unseating from said valve seat;

a spring in said throat plug assembly which is in engagement with said first valve to yieldably urge said first valve to its said closed position;

said first valve, when in its said closed position, preventing liquid within the container from flowing therefrom;

said first valve, when in its open position, permitting liquid within the container to flow therethrough;

a flow control assembly, having open upper and lower ends, positioned below said throat of said container;

said flow control assembly including a selectively vertically movable valve actuator which is selectively movable between upper and lower positions;

said first valve being in its said open position when said valve actuator is in its said lower position;

said valve actuator including a second valve which closes said valve seat when said valve actuator is in its said upper position.

5. The combination of claim 4 wherein said valve actuator is also rotatably movably mounted.

6. The combination of claim 4 wherein said valve actuator has a cam lever secured thereto which is movably positioned within a cam track.

7. In combination:

a dispensing fixture;

an inverted liquid container having upper and lower ends;

said lower end of said container having a hollow throat extending downwardly therefrom which has interior and exterior surfaces;

said throat of said container being detachably connected to said fixture;

a throat plug assembly having upper and lower ends, positioned in said throat of said container;

a first, normally closed valve movably positioned within said throat plug assembly;

said first valve being movable between open and closed positions;

said first valve, when in its said closed position, seating upon a valve seat;

said first valve, when in its said open position, unseating from said valve seat;

a spring in said throat plug assembly which is in engagement with said first valve to yieldably urge said first valve to its said closed position;

said first valve, when in its said closed position, preventing liquid within the container from flowing therefrom;

said first valve, when in its open position, permitting liquid within the container to flow therethrough;

a flow control assembly, having open upper and lower ends, secured to said fixture below said throat of said container;

said flow control assembly including a selectively vertically movable valve actuator which is selectively movable between upper and lower positions;

said first valve being in its said closed position when said valve actuator is in its said lower position;

said valve actuator, when in its said upper position, engaging said normally closed valve to open the same whereby liquid in said container may flow downwardly therefrom through said valve and through said flow control assembly;

said valve actuator having a cam lever secured thereto which is movably positioned within a cam track.

8. In combination:

an inverted liquid container having upper and lower ends;

said lower end of said container having a hollow throat extending downwardly therefrom which has interior and exterior surfaces;

a throat plug assembly having upper and lower ends, positioned in said throat of said container;

a first, normally closed valve movably positioned within said throat plug assembly;

said first valve being movable between open and closed positions;

said first valve, when in its said closed position, seating upon a valve seat;

said first valve, when in its said open position, unseating from said valve seat;

a spring in said throat plug assembly which is in engagement with said first valve to yieldably urge said first valve to its said closed position;

said first valve, when in its said closed position, preventing liquid within the container from flowing therefrom;

said first valve, when in its open position, permitting liquid within the container to flow therethrough;

a flow control assembly, having open upper and lower ends, positioned below said throat of said container;

said flow control assembly including a selectively vertically movable valve actuator which is selectively movable between upper and lower positions;

said first valve being in its said closed position when said valve actuator is in its said lower position;

said valve actuator, when in its said upper position, engaging said normally closed valve to open the same whereby liquid in said container may flow downwardly therefrom through said valve and through said flow control assembly;

said valve actuator having a cam lever secured thereto which is movably positioned within a cam track.

9. In combination:

an inverted liquid container having upper and lower ends;

said lower end of said container having a hollow throat extending downwardly therefrom which has interior and exterior surfaces;

a throat plug assembly having upper and lower ends, positioned in said throat of said container;

a first, normally closed valve movably positioned within said throat plug assembly;

said first valve being movable between open and closed positions;

said first valve, when in its said closed position, seating upon a valve seat;

said first valve, when in its said open position, unseating from said valve seat;

a spring in said throat plug assembly which is in engagement with said first valve to yieldably urge said first valve to its said closed position;

said first valve, when in its said closed position, preventing liquid within the container from flowing therefrom;

said first valve, when in its open position, permitting liquid within the container to flow therethrough;

a flow control assembly operably secured to said throat of said container, said flow control assembly including a cup-shaped reservoir having an open upper end and a lower end;

said lower end of said cup-shaped reservoir having a centrally disposed and vertically extending opening, having upper and lower ends, formed therein;

said flow control assembly also including a selectively vertically movable valve actuator which is selectively movable between upper and lower positions;

said valve actuator including a body portion, having upper and lower ends, which is vertically movably mounted in said opening of said reservoir;

said valve actuator including a rod extending upwardly from said upper end of said body portion thereof which is adapted to engage said first valve to move said first valve from its said closed position to its said open position when said valve actuator is moved to its said upper position;

said first valve being in its said closed position when said valve actuator is in its said lower position;

said body portion of said valve actuator having a central bore formed therein which extends upwardly thereinto from the lower end thereof and which terminates below the upper end thereof;

said body portion of said valve actuator having at least one inlet opening extending thereinto below its said upper end which is in communication with said central bore;

said inlet opening being closed when said valve actuator is in its said lower position;

said inlet opening being in communication with the interior of said reservoir when said valve actuator is in its said upper position;

said rod, when said valve actuator is in its said upper position, engaging said normally closed valve to open the same whereby liquid in said container may flow downwardly therefrom through said first valve, into said reservoir, into said inlet opening in said body portion, and downwardly through said central bore through the lower end of said central bore.

10. The combination of claim 9 wherein said body portion has a second valve at its upper end which closes the upper end of said central bore when said valve actuator is in its said lower position.

11. The combination of claim 10 wherein said valve actuator has a third valve which closes said valve seat when said valve actuator is in its said upper position.

* * * * *